US010677454B2

(12) United States Patent
Krichtafovitch

(10) Patent No.: US 10,677,454 B2
(45) Date of Patent: Jun. 9, 2020

(54) ELECTRICAL COMBUSTION CONTROL SYSTEM INCLUDING A COMPLEMENTARY ELECTRODE PAIR

(71) Applicant: ClearSign Combustion Corporation, Seattle, WA (US)

(72) Inventor: Igor A. Krichtafovitch, Kirkland, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 594 days.

(21) Appl. No.: 14/652,403

(22) PCT Filed: Nov. 15, 2013

(86) PCT No.: PCT/US2013/070423

§ 371 (c)(1),
(2) Date: Jun. 15, 2015

(87) PCT Pub. No.: WO2014/099193

PCT Pub. Date: Jun. 26, 2014

(65) Prior Publication Data

US 2015/0345780 A1 Dec. 3, 2015

Related U.S. Application Data

(60) Provisional application No. 61/745,540, filed on Dec. 21, 2012.

(51) Int. Cl.

| | |
|---|---|
| ***F23C 99/00*** | (2006.01) |
| *F23N 5/16* | (2006.01) |
| *F23M 11/04* | (2006.01) |

(52) U.S. Cl.
CPC ..... *F23C 99/001* (2013.01); *F23M 11/04* (2013.01); *F23N 5/16* (2013.01)

(58) Field of Classification Search
CPC ..... F23C 99/001; F23N 4/10
(Continued)

(56) References Cited

U.S. PATENT DOCUMENTS 1,983,430 A 12/1934 Aschcraft
2,604,936 A 7/1952 Kaehni et al.
(Continued)

FOREIGN PATENT DOCUMENTS

CA 2778722 A1 * 12/2013 ..... F23R 3/286
EP 0844434 5/1998
(Continued)

OTHER PUBLICATIONS

James Lawton et al., Electrical Aspects of Combustion, 1969, p. 81, Clarendon Press, Oxford, England.
(Continued)

*Primary Examiner* — Edelmira Bosques
*Assistant Examiner* — Nikhil P Mashruwala
(74) *Attorney, Agent, or Firm* — Christopher A. Wiklof; Nicholas S. Bromer; Launchpad IP, Inc.

(57) ABSTRACT

Two or more unipolar voltage generation systems may apply respective voltages to separate but complementary electrodes. The complementary electrodes may be disposed substantially congruently or analogously to one another to provide bipolar electrical effects on a combustion reaction.

96 Claims, 3 Drawing Sheets

(58) Field of Classification Search
USPC ..... 431/2, 8, 253, 350
See application file for complete search history.

(56) References Cited

U.S. PATENT DOCUMENTS 2,942,420 A 6/1960 Clark
3,004,137 A 10/1961 Karlovitz
3,087,472 A 4/1963 Yukichi
3,167,109 A 1/1965 Wobig
3,306,338 A 2/1967 Wright et al.
3,373,306 A 3/1968 Karlovitz
3,416,870 A 12/1968 Wright
3,749,545 A 7/1973 Velkoff
3,841,824 A * 10/1974 Bethel ..... F23C 99/001 123/536
4,020,388 A 4/1977 Pratt, Jr.
4,052,139 A 10/1977 Paillaud et al.
4,111,636 A 9/1978 Goldberg
4,255,238 A * 3/1981 Delapierre ..... G02F 1/163 204/450
4,362,016 A 12/1982 Papadopulos
4,664,783 A 2/1987 Roberts et al.
4,888,494 A * 12/1989 McNair ..... H05B 37/0209 307/38
4,995,805 A 2/1991 Hilliard
5,088,917 A 2/1992 Leleu et al.
5,298,146 A * 3/1994 Braden ..... G01N 27/404 204/406
5,498,154 A 5/1996 Velie et al.
5,577,905 A 11/1996 Momber et al.
5,620,616 A 4/1997 Anderson et al.
5,654,868 A 8/1997 Buer
5,666,019 A * 9/1997 Potter ..... H01J 3/022 313/306
5,702,244 A 12/1997 Goodson et al.
5,784,889 A 7/1998 Joos et al.
6,247,921 B1 6/2001 Helt
7,137,808 B2 11/2006 Branston et al.
7,159,646 B2 1/2007 Dessiatoun et al.
7,243,496 B2 7/2007 Pavlik et al.
7,481,043 B2 1/2009 Hirata et al.
7,523,603 B2 4/2009 Hagen et al.
7,944,678 B2 5/2011 Kaplan et al.
8,082,725 B2 12/2011 Younsi et al.
8,911,699 B2 12/2014 Colannino et al.
9,062,882 B2 6/2015 Hangauer et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,377,195 B2 6/2016 Goodson et al.
9,441,834 B2 * 9/2016 Colannino ..... F23C 99/001
9,453,640 B2 9/2016 Krichtafovitch et al.
10,066,835 B2 * 9/2018 Karkow ..... F23N 1/005
10,196,767 B2 * 2/2019 Deyts ..... D04H 3/002
10,364,980 B2 * 7/2019 Colannino ..... F23C 99/001
2002/0092302 A1 7/2002 Johnson et al.
2003/0203245 A1 10/2003 Dessiatoun et al.
2004/0183454 A1 * 9/2004 Krichtafovitch ..... H05H 1/24 315/111.91
2004/0185397 A1 9/2004 Branston et al.
2005/0116166 A1 * 6/2005 Krichtafovitch ..... H01T 19/00 250/324
2005/0208442 A1 9/2005 Heiligers et al.
2005/0208446 A1 9/2005 Jayne
2006/0165555 A1 7/2006 Spielman et al.
2007/0020567 A1 1/2007 Branston et al.
2007/0026354 A1 2/2007 Branston et al.
2008/0145802 A1 6/2008 Hammer et al.
2010/0183424 A1 7/2010 Roy
2011/0027734 A1 2/2011 Hartwick et al.
2011/0203771 A1 8/2011 Goodson et al.
2012/0156628 A1 6/2012 Lochschmied et al.
2012/0317985 A1 12/2012 Hartwick et al.
2013/0004902 A1 1/2013 Goodson et al.
2013/0071794 A1 3/2013 Colannino et al.
2013/0170090 A1 7/2013 Colannino et al.
2013/0230810 A1 9/2013 Goodson et al.
2013/0255482 A1 * 10/2013 Goodson ..... B01D 46/0032 95/3
2013/0260321 A1 10/2013 Colannino et al.
2013/0291552 A1 11/2013 Smith et al.
2013/0323661 A1 * 12/2013 Goodson ..... F27B 9/00 432/20
2013/0333279 A1 12/2013 Osler et al.
2013/0336352 A1 12/2013 Colannino et al.
2014/0038113 A1 * 2/2014 Breidenthal ..... F23N 5/16 431/2
2014/0050644 A1 * 2/2014 Colannino ..... B01D 53/346 423/235
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170575 A1 6/2014 Krichtafovitch
2014/0170576 A1 6/2014 Colannino et al.
2014/0170577 A1 6/2014 Colannino et al.
2014/0208758 A1 7/2014 Breidenthal et al.
2014/0227645 A1 * 8/2014 Krichtafovitch ..... F23N 5/00 431/2
2015/0079524 A1 3/2015 Colannino et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0241057 A1 8/2015 Krichtafovitch et al.
2015/0276211 A1 * 10/2015 Colannino ..... F23C 99/001 431/2
2015/0338089 A1 11/2015 Krichtafovitch et al.
2015/0362177 A1 * 12/2015 Krichtafovitch ..... F23C 99/001 431/8
2015/0362178 A1 * 12/2015 Karkow ..... F23C 99/001 431/8
2016/0040872 A1 * 2/2016 Colannino ..... F23C 99/001 431/2
2016/0123576 A1 5/2016 Colannino et al.
2016/0161115 A1 6/2016 Krichtafovitch et al.
2016/0245507 A1 8/2016 Goodson et al.
2017/0122553 A1 * 5/2017 Krichtafovitch ..... F23C 99/001
2017/0268769 A1 * 9/2017 Krichtafovitch ..... F23C 99/001

FOREIGN PATENT DOCUMENTS

EP 2738460 6/2014
FR 2577304 12/1989
GB 932955 7/1963
GB 1042014 9/1966
JP 58-019609 2/1983
JP 61-265404 11/1986
JP H 07-48136 2/1995
JP H 09-159166 6/1997
WO WO 1995/034784 12/1995
WO WO 19961001394 1/1996

OTHER PUBLICATIONS

Timothy J.C. Dolmansley et al., Electrical Modification of Combustion and the Affect of Electrode Geometry on the Field Produced, Modelling and Simulation in Engineering, May 26, 2011, 1-13, vol. 2011, Himdawi Publishing Corporation.

(56) References Cited

OTHER PUBLICATIONS

F. Altendorfner et al., Electric Field Effects on Emissions and Flame Stability with Optimized Electric Field Geometry, The European Combustion Meeting ECM 2007, 2007, 1-6, Germany.
PCT International Search Report and Written Opinion of International PCT Application No. PCT/US2013/070423 dated Feb. 26, 2014.
Zake et al., "Electric Field Control of NOx Formation in the Flame Channel Flows." Global Nest: the Int. J. May 000, vol. 2, No_ 1, pp. 99-108_.

* cited by examiner

ELECTRICAL COMBUSTION CONTROL SYSTEM INCLUDING A COMPLEMENTARY ELECTRODE PAIR

CROSS-REFERENCE TO RELATED APPLICATIONS

The present application is a U.S. National Phase application under 35 U.S.C. § 371 of International Patent Application No. PCT/US2013/070423, entitled "ELECTRICAL COMBUSTION CONTROL SYSTEM INCLUDING A COMPLEMENTARY ELECTRODE PAIR," filed Nov. 15, 2013; which application claims the benefit of U.S. Provisional Patent Application No. 61/745,540, entitled "ELECTRICAL COMBUSTION CONTROL SYSTEM INCLUDING A COMPLEMENTARY ELECTRODE PAIR," filed Dec. 21, 2012; each of which, to the extent not inconsistent with the disclosure herein, is incorporated herein by reference.

BACKGROUND

It has been found that the application of a high voltage to a combustion reaction can enhance the combustion reaction and/or drive the reaction, control or enhance heat derived therefrom, and/or cause flue gas derived therefrom to achieve a desirable parameter. In some embodiments, it may be desirable to drive an electrode assembly to a time-varying bipolar high voltage.

Efficiently driving a single electrode to an arbitrary high voltage bipolar waveform may present challenges to system cost, size, reliability, power consumption, etc. What is needed is an approach that can apply variable voltage or bipolar voltage to a combustion reaction-coupled electrode assembly while minimizing negatives.

SUMMARY

According to an embodiment, a system configured to apply time-varying electrical energy to a combustion reaction includes two electrodes including a first electrode and a second electrode operatively coupled to a combustion reaction in a combustion volume including or at least partly defined by a burner. A first unipolar voltage converter is operatively coupled to the first electrode and configured to output a first voltage for the first electrode. A second unipolar voltage converter is operatively coupled to the second electrode and configured to output a second voltage to the second electrode. A controller can be operatively coupled to the first and second unipolar voltage converters and configured to control when the first voltage is output by the first unipolar voltage converter for delivery to the first electrode and when the second voltage is output by the second unipolar voltage converter for delivery to the second electrode.

According to an embodiment, an electrode assembly for applying electrical energy to a combustion reaction includes a complementary electrode pair configured to apply a time-varying electrical waveform to a combustion reaction. The complementary electrode pair includes a first electrode configured to receive a first polarity voltage during a first time and a second electrode, electrically isolated from the first electrode, and configured to receive a second polarity voltage during a second time. The first and second electrodes are configured to cooperate to apply respective first and second polarities of electrical energy to the combustion reaction during respective first and second times.

DETAILED DESCRIPTION

Figure 1:
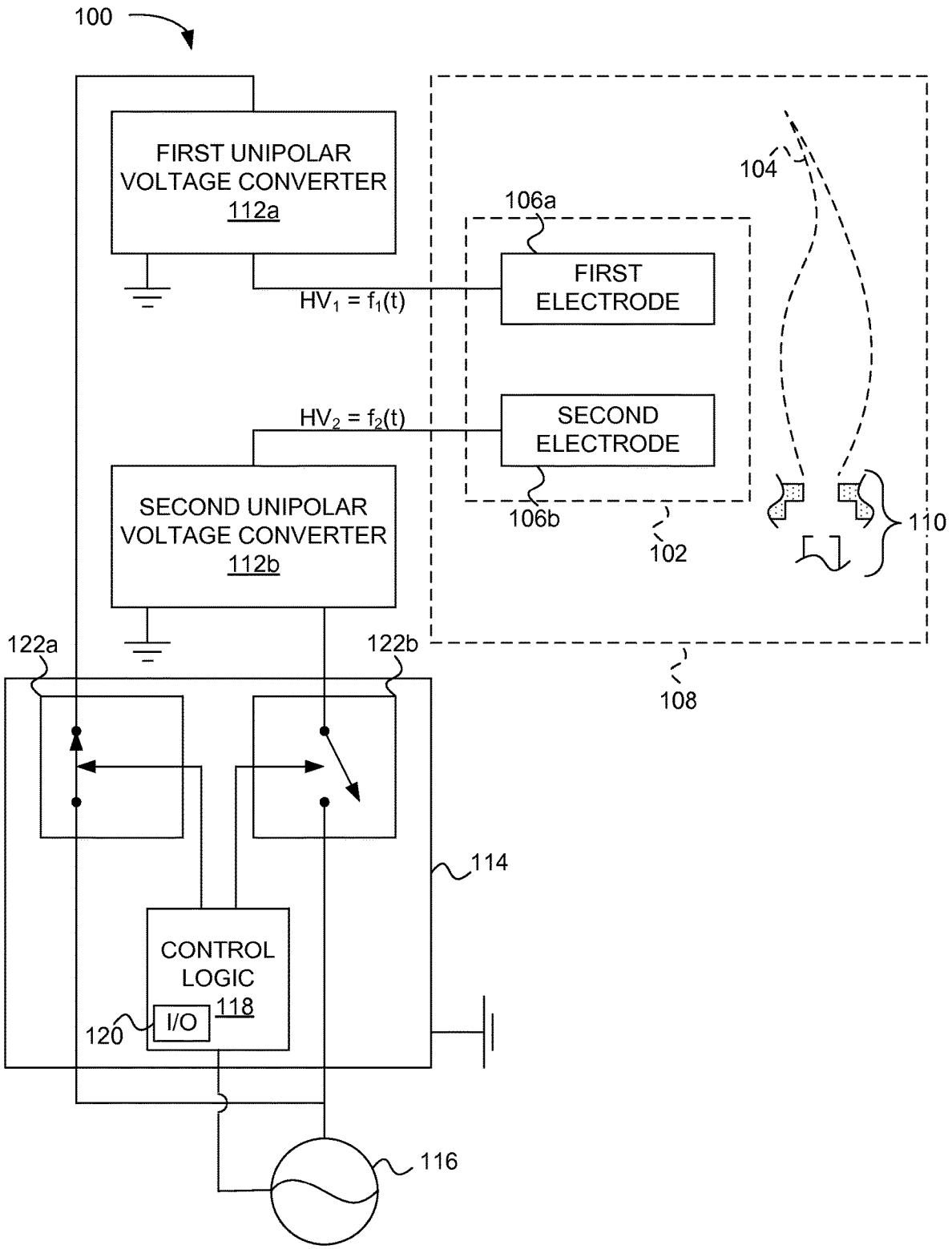
FIG. 1 is a diagram of a system configured to apply time-varying electrical energy to a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a diagram of a system 100 configured to apply time-varying electrical energy to a combustion reaction 104, according to an embodiment. The system 100 includes a complementary electrode pair 102. The complementary electrode pair includes a first electrode 106*a* and a second electrode 106*b* operatively coupled to a combustion reaction 104 in a combustion volume 108 including or at least partly defined by a burner 110.

The system 100 includes a first unipolar voltage converter 112*a* operatively coupled to the first electrode 106*a* and configured to output a first voltage for the first electrode 106*a*. A second unipolar voltage converter 112*b* is operatively coupled to the second electrode 106*b* and is configured to output a second voltage to the second electrode 106*b*.

An AC power source 116 can be operatively coupled to the first and second unipolar voltage converters 112*a*, 112*b*. A positive unipolar voltage converter 112*a* increases the voltage output by the AC power source 112 during positive portions of the AC waveform. A negative unipolar voltage converter 112*b* increases negative voltage output by the AC power source 112 during negative portions of the AC waveform. The first and second unipolar voltage converters 112*a*, 112*b* can each include a voltage multiplier, for example.

Optionally, a controller 114 is operatively coupled to the first and second unipolar voltage converters 112*a*, 112*b* and configured to control when the first voltage is output by the first unipolar voltage converter 112*a* for delivery to the first electrode 106*a* and when the second voltage is output by the second unipolar voltage converter 112*b* for delivery to the second electrode 106*b*. For embodiments including the controller 114, a DC power source can be substituted for an AC power source 116. Moreover, the controller 114 can increase a switching frequency applied to the first and second unipolar voltage converters 112*a*, 112*b* to a rate higher than the periodicity of an AC power source 116. The AC power source 116 (or optional DC power source) can optionally supply electrical power to operate the controller 114. Additionally or alternatively, the AC power source 116 can be operatively coupled to control logic 118 of the controller 114, for example to provide voltage signals for synchronization of the AC power source 116 with operation of the first and second unipolar voltage converters 112*a*, 112*b*.

The system 100 includes a burner 110. According to embodiments, at least the combustion volume 108 and the burner 110 comprise portions of a furnace, boiler, or process heater.

The first and second electrodes 106*a*, 106*b* of the complementary electrode pair 102 can be configured to apply electrical energy to the combustion reaction 104 from substantially congruent and/or analogous locations. Additionally and/or alternatively, the first and second electrodes 106*a*, 106*b* can be configured to respectively apply substantially antiparallel electric fields to the combustion reaction 104. Additionally and/or alternatively, the first and second electrodes 106*a*, 106*b* can be configured to at least intermittently cooperate to form an arc discharge selected to ignite the combustion reaction 104.

According to an embodiment, the first voltage output by the first unipolar voltage converter 112*a* is a positive voltage. The first voltage can be a positive polarity voltage having a value of greater than 1000 volts. For example, the first voltage can be a positive polarity voltage having a value of greater than 10,000 Volts.

According to an embodiment, the first unipolar voltage converter 112*a* can include a voltage multiplier or a charge pump configured to output a positive voltage. The second unipolar voltage converter 112*b* can include a voltage multiplier or a charge pump configured to output a negative voltage.

The second voltage can be a negative voltage having a value of greater than −1000 volts negative magnitude. For example, the second voltage can be a negative voltage having a value of greater than −10,000 volts magnitude.

The system 100 can include at least one voltage source 116 that is selectively operatively coupled to the first and second unipolar voltage converters 112*a*, 112*b*. The at least one voltage source 116 can include an alternating polarity (AC) voltage source. Additionally and/or alternatively, the at least one voltage source 116 can include at least one constant polarity (DC) voltage source.

According to an embodiment, the controller 114 can be configured to control pump switching of a first polarity voltage from either an AC voltage source or at least one constant polarity (DC) voltage source to the first unipolar voltage 2 converter 112*a*, and can control pump switching of a second polarity voltage from either an AC voltage source or at least one constant polarity (DC) voltage source to the second unipolar voltage converter 112*b*. The pump switching can be selected to cause stages of the first and second unipolar voltage sources 112*a*, 112*b* to increase the magnitudes of the first and second polarity voltages output by the one or more voltage sources 116 respectively to the first and second voltages output by the first and second unipolar voltage converters 112*a*, 112*b*.

The at least one voltage source can be set at different output levels for different embodiments. For example, according to one embodiment, the at least one voltage source 116 can be configured to output less than or equal to 1000 volts magnitude. According to another embodiment, the at least one voltage source 116 can be configured to output less than or equal to 230 volts magnitude. According to another embodiment, the at least one voltage source 116 can be configured to output less than or equal to 120 volts magnitude. According to another embodiment, the at least one voltage source 116 can be configured to output a safety extra-low voltage (SELV). For example, the at least one voltage source 116 can be configured to output less than or equal to 42.4 volts magnitude. According to another embodiment, the at least one voltage source 116 is configured to output less than or equal to 12 volts magnitude. According to another embodiment, the at least one voltage source 116 can be configured to output less than or equal to 5 volts magnitude.

The controller 114 can include a control logic circuit 118 configured to determine when to operatively couple at least one voltage source 116 to the first unipolar voltage converter 112*a* and when to operatively couple the at least one voltage source 116 to the second unipolar voltage converter 112*b*. According to an embodiment, the control logic circuit 118 can include or consist essentially of a timer. According to an embodiment, the control logic circuit 118 can include a microcontroller.

The control logic circuit 118 can include a data interface 120 configured to communicate with a human interface and/or an external computer-based control system, for example. A computer control system can be operatively coupled to a data interface portion of the control logic circuit 118. All or a portion of the computer control system can form a portion of the system 100.

According to an embodiment, the controller 114 can include at least one switching element 122*a*, 122*b* operatively coupled to the control logic circuit 118. The control logic circuit 118 can be configured to control the at least one switching element 122*a*, 122*b* to make electrical continuity between the at least one voltage source 116 and the first unipolar voltage converter 112*a* and break electrical continuity between the at least one voltage source 116 and the second unipolar voltage converter 112*b* during a first time segment. The control logic 118 can be configured to subsequently control the at least one switching element 122*a*, 122*b* to break electrical continuity between the at least one voltage source 116 and the first unipolar voltage converter 112*a* and make electrical continuity between the at least one voltage source 116 and the second unipolar voltage converter 112*b* during a second time segment. By repeating the complementary make-break cycle of powering the first unipolar voltage converter and then the second unipolar voltage converter, the first and second unipolar voltage converters 112*a*, 112*b* can cause the complementary electrode pair 102 to apply a bipolar voltage waveform to the combustion reaction 104. The first and second time segments together can form a bipolar electrical oscillation period applied to the first and second electrodes 106*a*, 106*b*.

In embodiments where one or more DC voltage sources 116 are selectively coupled to the first and second unipolar voltage converters 112*a*, 112*b*, the controller 114 can apply pumping switching to cause the voltage converters 112*a*, 112*b* to raise the input voltage provided by the voltage sources to high voltages applied to the first and second electrodes 106*a*, 106*b*. Such pump switching can typically occur at a relatively high frequency consistent with R-C time constants of the voltage converters 112*a*, 112*b*.

As used herein, pump switching refers to pumping a voltage converter 112*a*, 112*b* at a single polarity to cause the voltage converter 112*a* to multiply the input voltage. In contrast, cycle switching refers to switching the voltage converters 112*a*, 112*b* to change the polarity of voltage output by the electrode pair 102.

The cycle of making and breaking of continuity between the one or more voltage sources 116 and the voltage converters 112*a*, 112*b* typically occurs at a relatively low frequency consistent with the voltage converters 112*a*, 112*b* raising and holding their respective output voltage magnitudes for a substantial portion of each respective half cycle. For example, the first and second cycle switched time segments can be 5 times or more in duration than the pumping cycles. In another embodiment, the first and second time segments can be 10 times or more in duration than the pumping cycles. In another embodiment, the electrical oscillation period applied to the electrodes 106*a*, 106*b* can be about 100 times longer than the pumping period.

The bipolar electrical oscillation (cycle switching) frequency applied to the first and second electrodes can be between 200 and 300 Hertz, for example. Other bipolar electrical oscillation frequencies can be used according to the needs of a given combustion system and/or designer preferences.

According to an embodiment, the at least one switching element 122*a*, 122*b* can include a pair of relays and/or a double-throw relay. Additionally and/or alternatively, the at least one switching element 122*a*, 122*b* can include an electrically controlled single pole double throw (SPDT) switch.

The at least one switching element 122*a*, 122*b* can include one or more semiconductor devices. For example, the at least one switching element 122*a*, 122*b* can include an insulated gate bipolar transistor (IGBT), a field-effect transistor (FET), a Darlington transistor and/or at least two sets of transistors in series.

The system 100 includes an electrode assembly 102 for applying electrical energy to a combustion reaction 104, according to an embodiment. The system includes a complementary electrode pair 102 configured to apply a time-varying electrical waveform to a combustion reaction 104. The complementary electrode pair includes a first electrode 106*a* and a second electrode 106*b*. The first electrode 106*a* is configured to receive a first polarity voltage during a first time interval. The second electrode 106*b* is electrically isolated from the first electrode 106*a* and is configured to receive a second polarity voltage during a second time interval.

The first and second electrodes 106*a*, 106*b* are configured to cooperate to apply respective first and second polarities of electrical energy to the combustion reaction 104 during respective first and second times.

Optionally, the first and second electrodes 106*a*, 106*b* can be driven to provide a combustion ignition spark by simultaneously driving the first electrode 106*a* to a high positive voltage and driving the second electrode 106*b* to a high negative voltage. Optionally, the system 100 includes a sensor (not shown) configured to sense a combustion condition in the combustion volume 108 and operatively coupled to the controller 114. The controller can drive the first and second unipolar voltage converters 112*a*, 112*b* to apply opposite polarity high voltages respectively to the first and second electrodes 106*a*, 106*b* responsive to a sensed condition corresponding to flame 104 blow-out or responsive to a sensed condition indicative of unstable combustion.

Figure 2:
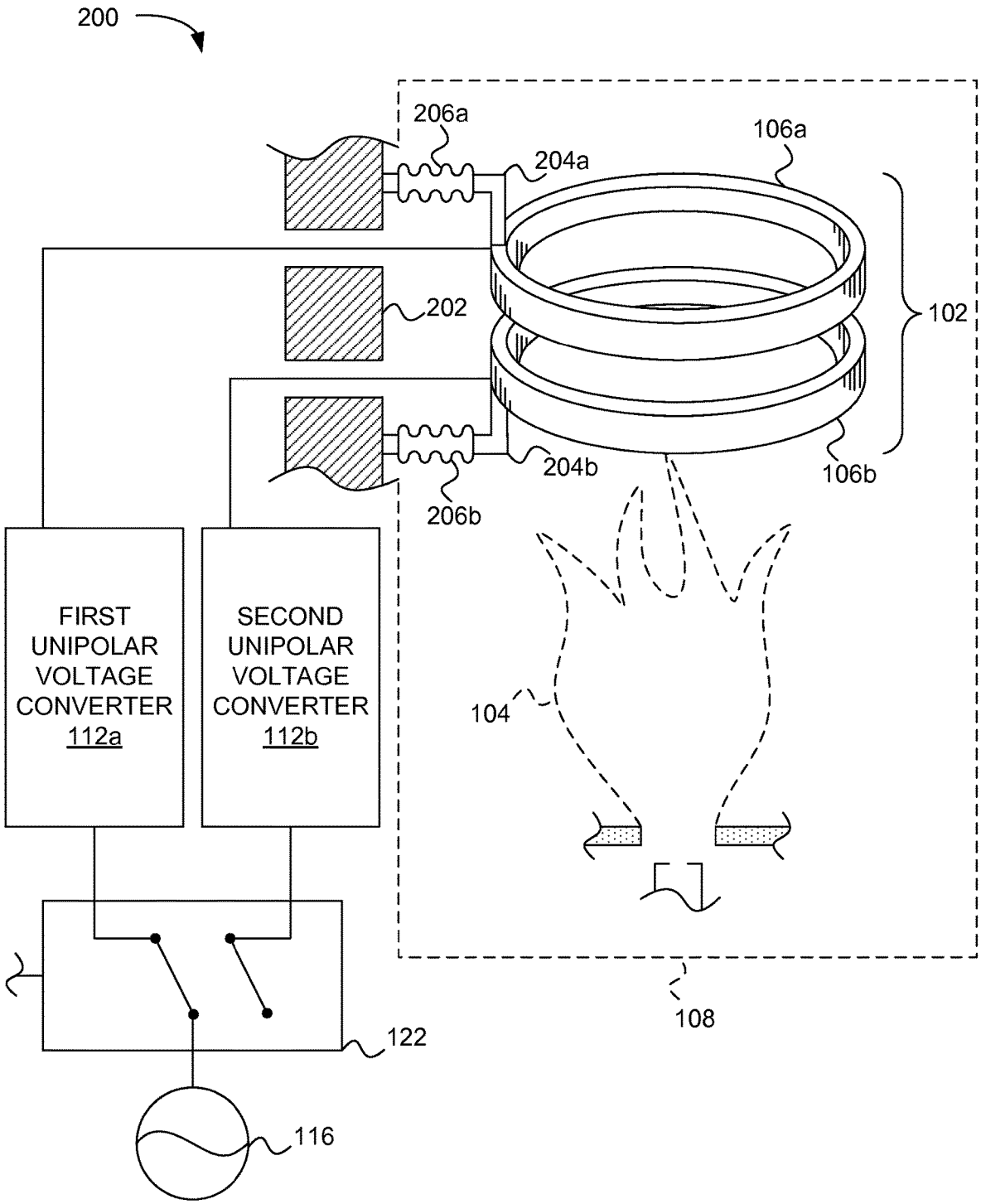
FIG. 2 is a diagram of a system configured to apply a time-varying bipolar electric field to a combustion reaction, according to an embodiment.

FIG. 2 is a diagram of a system 200 configured to apply a time-varying bipolar electric field to a combustion reaction, according to an embodiment. The system 200 includes first and second electrodes 106*a*, 106*b*. The first and second electrodes 106*a*, 106*b* can be configured to apply the electrical energy to the combustion reaction 104 from substantially congruent locations.

"Substantially congruent locations" is intended to mean locations resulting in electric fields caused by each electrode 106*a*, 106*b* of the complementary electrode pair 102 having a substantially equal and opposite effect on the combustion reaction 102. For example, in the embodiment 200 of FIG. 2, each electrode 106*a*, 106*b* can be considered substantially congruent, because as a pair the electrodes 106*a*, 106*b* apply similar but opposite electric fields to the combustion reaction 104. Electrodes 106*a*, 106*b* in substantially congruent locations occupy regions of space that are close together, at least relative to the scale of the combustion volume 108 and/or the combustion reaction 104. Because opposite-sign voltages in close proximity can cause electrical arcing, closely-spaced complementary electrodes 106*a*, 106*b* can be placed sufficiently far apart to prevent arc discharge therebetween. A set of complementary electrodes 106*a*, 106*b* can be considered substantially congruent when they are placed close enough together to cause similar effect on the combustion reaction 104 (albeit with opposite polarity voltages) and far enough apart to substantially prevent electrical arc discharge between the electrodes 106*a*, 106*b*. Additionally or alternatively, the first and second electrodes 106*a*, 106*b* can include features that are placed sufficiently close together to support a spark discharge when the controller 122 causes the first and second unipolar voltage converters 112*a*, 112*b* to simultaneously apply opposite polarity voltages to the first and second electrodes 106*a*, 106*b*.

The first and second electrodes 106*a*, 106*b* can be configured as field electrodes capable of applying antiparallel electric fields to the combustion reaction 104. The first and second electrodes 106*a*, 106*b* can be toric, as shown in FIG. 2.

Figure 3:
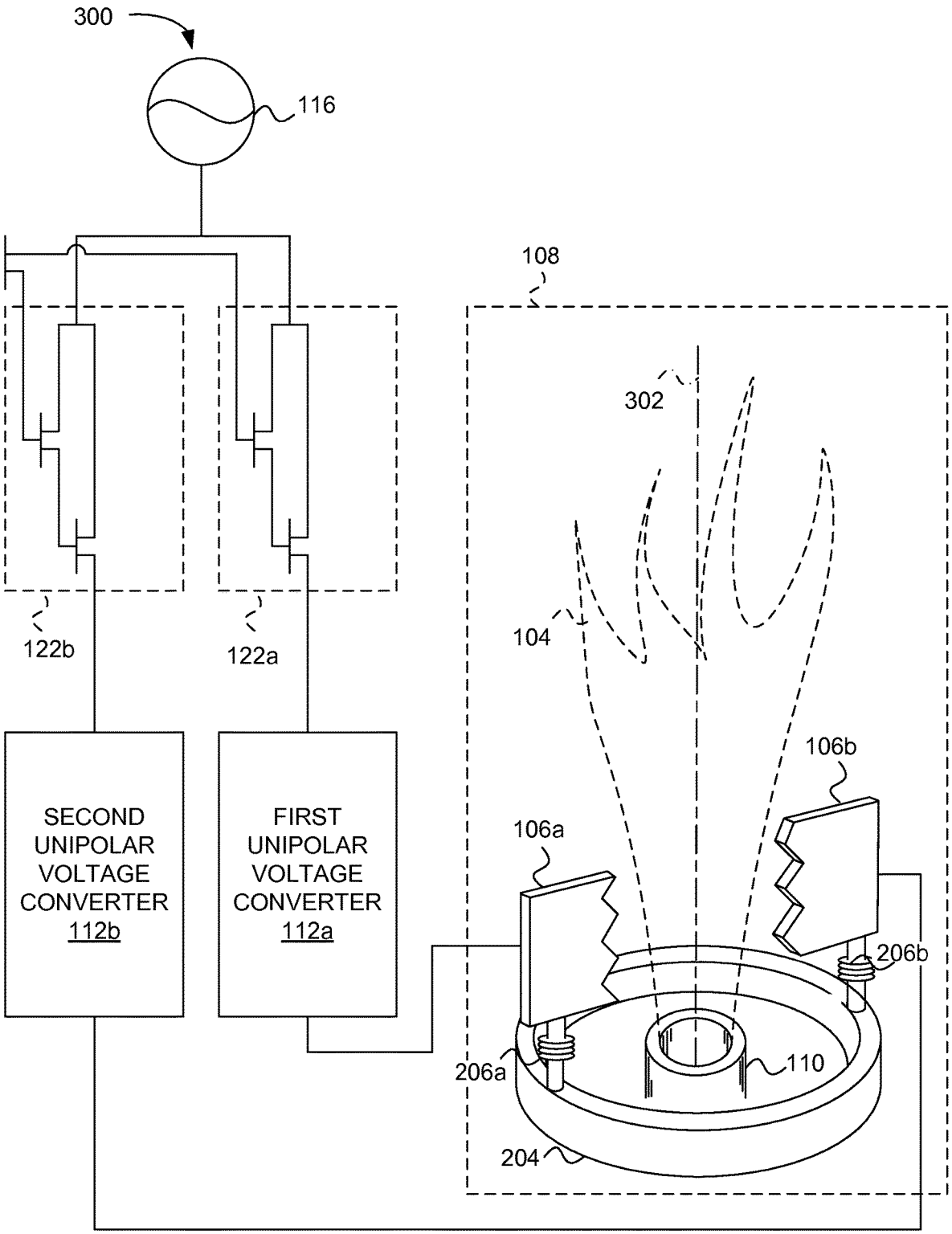
FIG. 3 is a diagram of a system configured to apply a time-varying bipolar charge to a combustion reaction, according to an embodiment.

FIG. 3 is a diagram of a system 300 configured to apply a time-varying bipolar charge to a combustion reaction, according to an embodiment.

According to an embodiment, the first and second electrodes 106*a*, 106*b* can be configured to respectively eject oppositely charged ions for transmission to the combustion reaction 104. The system 300 illustrates first and second electrodes 106*a*, 106*b* configured to apply the electrical energy to the combustion reaction from analogous locations.

Analogous locations refers to locations from which each electrode 106*a*, 106*b* can produce the same effect on the combustion reaction, albeit with opposite polarity. For example, in the embodiment 300 of FIG. 3, two ion ejecting electrodes 106*a*, 106*b* are disposed near a combustion reaction 104, configured to respectively apply positive and negative ions to the combustion reaction. If the polarities of the voltages applied to the electrodes 106*a* and 106*b* were reversed, each would still function substantially identically, albeit with opposite polarities. For example, in the embodiment 300, an axis 302 can be defined by the burner 110 and the combustion reaction 104 (at least near the electrodes 106*a*, 106*b*). The analogous locations of the first and second electrodes 106*a*, 106*b* can be axisymmetric locations.

According to an embodiment, the first and second electrodes 106*a*, 106*b* can be ion-ejecting electrodes. For example, the first and second electrodes 106*a*, 106*b* can be configured to apply a respective opposite polarity majority charge to the combustion reaction 104.

Referring to FIGS. 2 and 3, an electrode support apparatus 204, 204*a*, 204*b* can be configured to support the electrodes 106*a*, 106*b* forming the complementary electrode pair 102. The electrode support apparatus 204, 204*a*, 204*b* can be configured to support at least the first and second electrodes 106*a*, 106*b* within a combustion volume 108. For example, as indicated in FIG. 2, a combustor wall 202 can define at least a portion of the combustion volume 108. The electrode support apparatus 204*a*, 204*b* support the electrodes 106*a*, 106*b* from the combustion volume wall 202. The electrode support apparatus 204, 204*a*, 204*b* can include at least one insulator 206*a*, 206*b* configured to insulate voltages placed on the electrodes 106*a*, 106*b* from one another. The at least one insulator 206*a*, 206*b* can be further configured to insulate voltages placed on the electrodes 106*a*, 106*b* from ground.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system configured to apply time-varying electrical energy to a combustion reaction, the system comprising:

at least two electrodes including a first electrode and a second electrode operatively couple-able to the combustion reaction in a combustion volume including or at least partly defined by a burner;

a first unipolar voltage converter operatively coupled to the first electrode and configured to output a first voltage for the first electrode, the first voltage resulting from conversion, by the first unipolar voltage converter, of a first polarity voltage from at least one voltage source;

a second unipolar voltage converter operatively coupled to the second electrode and configured to output a second voltage to the second electrode, the second voltage resulting from conversion, by the second unipolar voltage converter, of a second polarity voltage from the at least one voltage source; and a controller operatively coupled to the first and second unipolar voltage converters and configured to control such that the first voltage is output by the first unipolar voltage converter for delivery to the first electrode during a first time segment and the second voltage is output by the second unipolar voltage converter for delivery to the second electrode during a second time segment;

wherein the first and second electrodes are configured to apply the electrical energy to the combustion reaction from substantially congruent locations.

2. The system configured to apply time-varying electrical energy to the combustion reaction of claim 1, further comprising the burner.

3. The system configured to apply time-varying electrical energy to the combustion reaction of claim 1, wherein at least the combustion volume and the burner comprise portions of a furnace, boiler, or process heater.

4. The system configured to apply time-varying electrical energy to the combustion reaction of claim 1, wherein the first and second electrodes are configured to respectively apply substantially antiparallel electric fields to the combustion reaction.

5. The system configured to apply time-varying electrical energy to the combustion reaction of claim 1, wherein the first and second electrodes are configured to respectively eject oppositely charged ions for transmission to the combustion reaction.

6. The system configured to apply time-varying electrical energy to the combustion reaction of claim 1, wherein the first and second electrodes are configured to at least intermittently cooperate to form an arc discharge selected to ignite the combustion reaction.

7. The system configured to apply time-varying electrical energy to the combustion reaction of claim 1, wherein the first voltage output by the first unipolar voltage converter is a positive voltage.

8. The system configured to apply time-varying electrical energy to the combustion reaction of claim 1, wherein the first voltage is a positive polarity voltage having a value of greater than 1000 volts.

9. The system configured to apply time-varying electrical energy to the combustion reaction of claim 8, wherein the first voltage is a positive polarity voltage having a value of greater than 10,000 volts.

10. The system configured to apply time-varying electrical energy to the combustion reaction of claim 1, wherein the first unipolar voltage converter includes a voltage multiplier or a charge pump configured to output a positive voltage.

11. The system configured to apply time-varying electrical energy to the combustion reaction of claim 1, wherein the second voltage output by the second unipolar voltage converter is a negative voltage.

12. The system configured to apply time-varying electrical energy to the combustion reaction of claim 1, wherein the second unipolar voltage converter includes a voltage multiplier or a charge pump configured to output a negative voltage.

13. The system configured to apply time-varying electrical energy to the combustion reaction of claim 1, wherein the second voltage is a negative voltage having a value of greater than −1000 volts negative magnitude.

14. The system configured to apply time-varying electrical energy to the combustion reaction of claim 13, wherein the second voltage is a negative voltage having a value of greater than −10,000 volts negative magnitude.

15. The system configured to apply time-varying electrical energy to the combustion reaction of claim 1, further comprising the at least one voltage source operatively coupled to the first and second unipolar voltage converters.

16. The system configured to apply time-varying electrical energy to the combustion reaction of claim 15, wherein the at least one voltage source includes an alternating polarity (AC) voltage source.

17. The system configured to apply time-varying electrical energy to the combustion reaction of claim 15, wherein the at least one voltage source includes at least one constant polarity (DC) voltage source;

wherein the controller is configured to control pump switching of a first polarity voltage from the at least one constant polarity (DC) voltage source to the first unipolar voltage converter, and to control pump switching of a second polarity voltage from the at least one constant polarity (DC) voltage source to the second unipolar voltage converter; and wherein the pump switching is selected to cause stages of the first and second unipolar voltage sources to increase the magnitudes of the first and second polarity voltages output by the one or more voltage sources respectively to the first and second voltages output by the first and second unipolar voltage sources.

18. The system configured to apply time-varying electrical energy to the combustion reaction of claim 15, wherein the at least one voltage source is configured to output less than or equal to 1000 volts magnitude.

19. The system configured to apply time-varying electrical energy to the combustion reaction of claim 18, wherein the at least one voltage source is configured to output less than or equal to 230 volts magnitude.

20. The system configured to apply time-varying electrical energy to the combustion reaction of claim 19, wherein the at least one voltage source is configured to output less than or equal to 120 volts magnitude.

21. The system configured to apply time-varying electrical energy to the combustion reaction of claim 20, wherein the at least one voltage source is configured to output a safety extra-low voltage (SELV).

22. The system configured to apply time-varying electrical energy to the combustion reaction of claim 21, wherein the at least one voltage source is configured to output less than or equal to 42.4 volts magnitude.

23. The system configured to apply time-varying electrical energy to the combustion reaction of claim 22, wherein the at least one voltage source is configured to output less than or equal to 12 volts magnitude.

24. The system configured to apply time-varying electrical energy to the combustion reaction of claim 23, wherein the at least one voltage source is configured to output less than or equal to 5 volts magnitude.

25. The system configured to apply time-varying electrical energy to the combustion reaction of claim 1, wherein the controller includes a control logic circuit configured to determine when to operatively couple at least one voltage source to the first unipolar voltage converter and when to operatively couple the at least one voltage source to the second unipolar voltage converter.

26. The system configured to apply time-varying electrical energy to the combustion reaction of claim 25, wherein the control logic circuit comprises a timer.

27. The system configured to apply time-varying electrical energy to the combustion reaction of claim 25, wherein the control logic circuit comprises a microcontroller.

28. The system configured to apply time-varying electrical energy to the combustion reaction of claim 25, wherein the control logic circuit includes a data interface configured to communicate with a human interface or an external computer-based control system.

29. The system configured to apply time-varying electrical energy to the combustion reaction of claim 25, further comprising:

a computer control system operatively coupled to a data interface portion of the control logic circuit.

30. The system configured to apply time-varying electrical energy to the combustion reaction of claim 25, wherein the controller includes at least one switching element operatively coupled to the control logic circuit;

wherein the control logic is configured to:

control the at least one switching element to make electrical continuity between the at least one voltage source and the first unipolar voltage converter and break electrical continuity between the at least one voltage source and the second unipolar voltage converter during the first time segment, and control the at least one switching element to break electrical continuity between the at least one voltage source and the first unipolar voltage converter and make electrical continuity between the at least one voltage source and the second unipolar voltage converter during the second time segment; and wherein the first time segment and the second time segment do not overlap.

31. The system configured to apply time-varying electrical energy to the combustion reaction of claim 30, wherein the first and second time segments together form a bipolar electrical oscillation period applied to the first and second electrodes.

32. The system configured to apply time-varying electrical energy to the combustion reaction of claim 31, wherein a bipolar electrical oscillation frequency applied to the first and second electrodes is between 200 and 300 Hertz.

33. The system configured to apply time-varying electrical energy to the combustion reaction of claim 30, wherein the at least one switching element includes a pair of relays or a double-throw relay.

34. The system configured to apply time-varying electrical energy to the combustion reaction of claim 31, wherein the at least one switching element includes an electrically controlled single pole double throw (SPDT) switch.

35. The system configured to apply time-varying electrical energy to the combustion reaction of claim 31, wherein the at least one switching element includes one or more semiconductor devices.

36. The system configured to apply time-varying electrical energy to the combustion reaction of claim 35, wherein the at least one switching element includes an insulated gate bipolar transistor (IGBT).

37. The system configured to apply time-varying electrical energy to the combustion reaction of claim 35, wherein the at least one switching element includes a field-effect transistor (FET).

38. The system configured to apply time-varying electrical energy to the combustion reaction of claim 35, wherein the at least one switching element includes a Darlington transistor.

39. The system configured to apply time-varying electrical energy to the combustion reaction of claim 35, wherein the at least one switching element includes at least two sets of transistors in series.

40. An electrode assembly for applying electrical energy to a combustion reaction, comprising:

a complementary electrode pair configured to apply a time-varying electrical waveform to the combustion reaction, the complementary electrode pair including a first electrode configured to receive a first polarity voltage during a first time interval and a second electrode, electrically isolated from the first electrode and configured to receive a second polarity voltage during a second time interval;

wherein the first and second electrodes are configured to cooperate to apply respective first and second polarities of electrical energy to the combustion reaction during respective first time segments and second time segments, and the first and second electrodes are configured to apply a majority charge to the combustion reaction; and wherein the first and second electrodes are configured to apply the electrical energy to the combustion reaction from substantially congruent locations.

41. The electrode assembly for applying electrical energy to the combustion reaction of claim 40, wherein the first and second electrodes are configured as field electrodes capable of applying antiparallel electric fields to the combustion reaction.

42. The electrode assembly for applying electrical energy to the combustion reaction of claim 40, wherein the first and second electrodes are toric.

43. The electrode assembly for applying electrical energy to a combustion reaction of claim 40, wherein the substantially congruent locations of the first and second electrodes are axisymmetric locations.

44. The electrode assembly for applying electrical energy to the combustion reaction of claim 40, wherein the first and second electrodes are ion-ejecting electrodes.

45. The electrode assembly for applying electrical energy to the combustion reaction of claim 40, further comprising:

an electrode support apparatus configured to support at least the first and second electrodes within a combustion volume.

46. The electrode assembly for applying electrical energy to the combustion reaction of claim 45, wherein the electrode support apparatus includes at least one insulator configured to insulate voltages placed on the electrodes from one another.

47. The electrode assembly for applying electrical energy to the combustion reaction of claim 45, wherein the electrode support apparatus includes at least one insulator configured to insulate voltages placed on the electrodes from ground.

48. The system configured to apply time-varying electrical energy to the combustion reaction of claim 1, wherein the controller is configured for a make-break cycle of powering the first unipolar voltage converter and then the second unipolar voltage converter.

49. A system configured to apply time-varying electrical energy to a combustion reaction, the system comprising:

at least two electrodes including a first electrode and a second electrode operatively couple-able to the combustion reaction in a combustion volume including or at least partly defined by a burner;

a first unipolar voltage converter operatively coupled to the first electrode and configured to output a first voltage for the first electrode, the first voltage resulting from conversion, by the first unipolar voltage converter, of a first polarity voltage from at least one voltage source;

a second unipolar voltage converter operatively coupled to the second electrode and configured to output a second voltage to the second electrode, the second voltage resulting from conversion, by the second unipolar voltage converter, of a second polarity voltage from the at least one voltage source; and a controller operatively coupled to the first and second unipolar voltage converters and configured to control such that the first voltage is output by the first unipolar voltage converter for delivery to the first electrode during a first time segment and the second voltage is output by the second unipolar voltage converter for delivery to the second electrode during a second time segment;

wherein the first and second electrodes are configured to apply the electrical energy to the combustion reaction from analogous locations.

50. The system configured to apply time-varying electrical energy to the combustion reaction of claim 49, further comprising the burner.

51. The system configured to apply time-varying electrical energy to the combustion reaction of claim 49, wherein at least the combustion volume and the burner comprise portions of a furnace, boiler, or process heater.

52. The system configured to apply time-varying electrical energy to the combustion reaction of claim 49, wherein the first and second electrodes are configured to respectively apply substantially antiparallel electric fields to the combustion reaction.

53. The system configured to apply time-varying electrical energy to the combustion reaction of claim 49, wherein the first and second electrodes are configured to respectively eject oppositely charged ions for transmission to the combustion reaction.

54. The system configured to apply time-varying electrical energy to the combustion reaction of claim 49, wherein the first and second electrodes are configured to at least intermittently cooperate to form an arc discharge selected to ignite the combustion reaction.

55. The system configured to apply time-varying electrical energy to the combustion reaction of claim 49, wherein the first voltage output by the first unipolar voltage converter is a positive voltage.

56. The system configured to apply time-varying electrical energy to the combustion reaction of claim 49, wherein the first voltage is a positive polarity voltage having a value of greater than 1000 volts.

57. The system configured to apply time-varying electrical energy to the combustion reaction of claim 56, wherein the first voltage is a positive polarity voltage having a value of greater than 10,000 volts.

58. The system configured to apply time-varying electrical energy to the combustion reaction of claim 49, wherein the first unipolar voltage converter includes a voltage multiplier or a charge pump configured to output a positive voltage.

59. The system configured to apply time-varying electrical energy to the combustion reaction of claim 49, wherein the second voltage output by the second unipolar voltage converter is a negative voltage.

60. The system configured to apply time-varying electrical energy to the combustion reaction of claim 49, wherein the second unipolar voltage converter includes a voltage multiplier or a charge pump configured to output a negative voltage.

61. The system configured to apply time-varying electrical energy to the combustion reaction of claim 49, wherein the second voltage is a negative voltage having a value of greater than −1000 volts negative magnitude.

62. The system configured to apply time-varying electrical energy to the combustion reaction of claim 61, wherein the second voltage is a negative voltage having a value of greater than −10,000 volts negative magnitude.

63. The system configured to apply time-varying electrical energy to the combustion reaction of claim 49, further comprising the at least one voltage source operatively coupled to the first and second unipolar voltage converters.

64. The system configured to apply time-varying electrical energy to the combustion reaction of claim 63, wherein the at least one voltage source includes an alternating polarity (AC) voltage source.

65. The system configured to apply time-varying electrical energy to the combustion reaction of claim 63, wherein the at least one voltage source includes at least one constant polarity (DC) voltage source;

wherein the controller is configured to control pump switching of a first polarity voltage from the at least one constant polarity (DC) voltage source to the first unipolar voltage converter, and to control pump switching of a second polarity voltage from the at least one constant polarity (DC) voltage source to the second unipolar voltage converter; and wherein the pump switching is selected to cause stages of the first and second unipolar voltage sources to increase the magnitudes of the first and second polarity voltages output by the one or more voltage sources respectively to the first and second voltages output by the first and second unipolar voltage sources.

66. The system configured to apply time-varying electrical energy to the combustion reaction of claim 63, wherein the at least one voltage source is configured to output less than or equal to 1000 volts magnitude.

67. The system configured to apply time-varying electrical energy to the combustion reaction of claim 66, wherein the at least one voltage source is configured to output less than or equal to 230 volts magnitude.

68. The system configured to apply time-varying electrical energy to the combustion reaction of claim 67, wherein the at least one voltage source is configured to output less than or equal to 120 volts magnitude.

69. The system configured to apply time-varying electrical energy to the combustion reaction of claim 68, wherein the at least one voltage source is configured to output a safety extra-low voltage (SELV).

70. The system configured to apply time-varying electrical energy to the combustion reaction of claim 69, wherein the at least one voltage source is configured to output less than or equal to 42.4 volts magnitude.

71. The system configured to apply time-varying electrical energy to the combustion reaction of claim 70, wherein the at least one voltage source is configured to output less than or equal to 12 volts magnitude.

72. The system configured to apply time-varying electrical energy to the combustion reaction of claim 71, wherein the at least one voltage source is configured to output less than or equal to 5 volts magnitude.

73. The system configured to apply time-varying electrical energy to the combustion reaction of claim 49, wherein the controller includes a control logic circuit configured to determine when to operatively couple at least one voltage source to the first unipolar voltage converter and when to operatively couple the at least one voltage source to the second unipolar voltage converter.

74. The system configured to apply time-varying electrical energy to the combustion reaction of claim 73, wherein the control logic circuit comprises a timer.

75. The system configured to apply time-varying electrical energy to the combustion reaction of claim 73, wherein the control logic circuit comprises a microcontroller.

76. The system configured to apply time-varying electrical energy to the combustion reaction of claim 73, wherein the control logic circuit includes a data interface configured to communicate with a human interface or an external computer-based control system.

77. The system configured to apply time-varying electrical energy to the combustion reaction of claim 73, further comprising:

a computer control system operatively coupled to a data interface portion of the control logic circuit.

78. The system configured to apply time-varying electrical energy to the combustion reaction of claim 73, wherein the controller includes at least one switching element operatively coupled to the control logic circuit;

wherein the control logic is configured to:

control the at least one switching element to make electrical continuity between the at least one voltage source and the first unipolar voltage converter and break electrical continuity between the at least one voltage source and the second unipolar voltage converter during the first time segment, and control the at least one switching element to break electrical continuity between the at least one voltage source and the first unipolar voltage converter and make electrical continuity between the at least one voltage source and the second unipolar voltage converter during the second time segment; and wherein the first time segment and the second time segment do not overlap.

79. The system configured to apply time-varying electrical energy to the combustion reaction of claim 78, wherein the first and second time segments together form a bipolar electrical oscillation period applied to the first and second electrodes.

80. The system configured to apply time-varying electrical energy to the combustion reaction of claim 79, wherein a bipolar electrical oscillation frequency applied to the first and second electrodes is between 200 and 300 Hertz.

81. The system configured to apply time-varying electrical energy to the combustion reaction of claim 78, wherein the at least one switching element includes a pair of relays or a double-throw relay.

82. The system configured to apply time-varying electrical energy to the combustion reaction of claim 79, wherein the at least one switching element includes an electrically controlled single pole double throw (SPDT) switch.

83. The system configured to apply time-varying electrical energy to the combustion reaction of claim 79, wherein the at least one switching element includes one or more semiconductor devices.

84. The system configured to apply time-varying electrical energy to the combustion reaction of claim 83, wherein the at least one switching element includes an insulated gate bipolar transistor (IGBT).

85. The system configured to apply time-varying electrical energy to the combustion reaction of claim 83, wherein the at least one switching element includes a field-effect transistor (FET).

86. The system configured to apply time-varying electrical energy to the combustion reaction of claim 83, wherein the at least one switching element includes a Darlington transistor.

87. The system configured to apply time-varying electrical energy to the combustion reaction of claim 83, wherein the at least one switching element includes at least two sets of transistors in series.

88. The system configured to apply time-varying electrical energy to the combustion reaction of claim 49, wherein the controller is configured for a make-break cycle of powering the first unipolar voltage converter and then the second unipolar voltage converter.

89. An electrode assembly for applying electrical energy to a combustion reaction, comprising:

a complementary electrode pair configured to apply a time-varying electrical waveform to the combustion reaction, the complementary electrode pair including a first electrode configured to receive a first polarity voltage during a first time interval and a second electrode, electrically isolated from the first electrode and configured to receive a second polarity voltage during a second time interval;

wherein the first and second electrodes are configured to cooperate to apply respective first and second polarities of electrical energy to the combustion reaction during respective first time segments and second time segments, and the first and second electrodes are configured to apply a majority charge to the combustion reaction; and wherein the first and second electrodes are configured to apply the electrical energy to the combustion reaction from analogous locations.

90. The electrode assembly for applying electrical energy to the combustion reaction of claim 89, wherein the first and second electrodes are configured as field electrodes capable of applying antiparallel electric fields to the combustion reaction.

91. The electrode assembly for applying electrical energy to the combustion reaction of claim 89, wherein the first and second electrodes are toric.

92. The electrode assembly for applying electrical energy to a combustion reaction of claim 89, wherein the analogous locations of the first and second electrodes are axisymmetric locations.

93. The electrode assembly for applying electrical energy to the combustion reaction of claim 89, wherein the first and second electrodes are ion-ejecting electrodes.

94. The electrode assembly for applying electrical energy to the combustion reaction of claim 89, further comprising:

an electrode support apparatus configured to support at least the first and second electrodes within a combustion volume.

95. The electrode assembly for applying electrical energy to the combustion reaction of claim 94, wherein the electrode support apparatus includes at least one insulator configured to insulate voltages placed on the electrodes from one another.

96. The electrode assembly for applying electrical energy to the combustion reaction of claim 94, wherein the electrode support apparatus includes at least one insulator configured to insulate voltages placed on the electrodes from ground.

* * * * *